US006067772A

United States Patent [19]

Kraft et al.

[11] Patent Number: 6,067,772

[45] Date of Patent: May 30, 2000

[54] PORTIONING APPARATUS

[75] Inventors: Eberhard Kraft, Neckarbischofsheim, Germany; Hans-Peter Wild, Zug, Switzerland

[73] Assignee: Indag Gesellschaft fur Industriebedarf m.b.H, Eppelheim/Heidelberg, Germany

[21] Appl. No.: 09/163,617

[22] Filed: Sep. 30, 1998

[30] Foreign Application Priority Data

Oct. 16, 1997 [DE] Germany ..... 197 45 854

[51] Int. Cl.[7] ..... B65B 1/04

[52] U.S. Cl. ..... 53/240; 53/443; 53/247

[58] Field of Search ..... 53/240, 237, 246, 53/251, 202, 542, 539, 544, 168, 443

[56] References Cited

U.S. PATENT DOCUMENTS

| | | | |
|---|---|---|---|
| 1,016,432 | 2/1912 | Nolan | 53/240 |
| 5,502,950 | 4/1996 | Moncrief et al. | 53/251 |

FOREIGN PATENT DOCUMENTS

| | | |
|---|---|---|
| 2 365 082 | 7/1974 | Germany . |
| 2 315 895 | 10/1974 | Germany . |
| 23 15 895 | 10/1974 | Germany . |

*Primary Examiner*—Peter Vo
*Assistant Examiner*—Louis K. Huynh
*Attorney, Agent, or Firm*—Tilton, Fallon, Lungmus & Chestnut

[57] ABSTRACT

A packing apparatus for packing bags in packaging containers, the apparatus comprising a conveying means for the packaging containers, an endless transportation means including receiving chambers in which respective groups of sheet bags are transported that are to form a partial filling in the packaging containers, and at least two discharge stations in which the bags corresponding to one partial filling are respectively discharged into the packaging containers at the same time, and to a corresponding method. The conveying means can transport at least two packaging containers side by side and the endless transportation means is provided in the area of the discharge stations with straight discharge sections in which at least two discharge stations are respectively arranged side by side.

12 Claims, 2 Drawing Sheets

PORTIONING APPARATUS

FIELD OF THE INVENTION

The present invention relates to a packing apparatus for bags in packaging containers, and to a method for packaging bags in packaging containers.

A generic packing apparatus is known from DE 23 15 895 C2. At the end of a filling system for sheet bags, the bags are combined to obtain packaging units and are packaged in packaging containers, e.g. cardboard boxes, for transportation or sale purposes. Suitable bags are e.g. sheet bags which after having been filled are sealed and thus closed. For automatic packaging a plurality of bags are respectively combined to form a group in one row and are transported in receiving chambers of a transportation means to a discharge station. At this discharge station a respective group of bags is ejected into packaging containers which are guided along by a conveying means underneath the transportation means. The transportation means is here of an endless type. At a second discharge station which is opposite to the first discharge station, a second group of bags is ejected into the packaging containers, so that the packaging containers are filled with two partial fillings, the bags of each partial filling being identically oriented with respect to one another.

In the known packing apparatus, the transportation apparatus is a circular carrousel. The receiving chambers for the groups of bags that are to form a partial filling of a packaging container extend essentially radially in said carrousel. An angle is thereby created between two neighboring receiving chambers.

SUMMARY OF THE INVENTION

It is therefore the object of the present invention to provide a packing apparatus and a method with the help of which a greater number of bags can be filled into packaging containers within a shorter period of time, thereby increasing efficiency and profitability.

In the packing apparatus of the invention, the conveying means is designed such that at least two packaging containers can be transported in parallel and side by side. In the area of the discharge stations, the endless transportation means has straight sections, with at least two discharge stations being respectively arranged side by side in the straight discharge sections.

Thanks to the straight discharge sections, at least two partial groups of bags can be discharged in parallel in the same orientation. Thus, two packaging containers that are supplied side by side can be fed at the same time. By contrast, in the known apparatus of DE 23 15 895 C2, different packaging containers cannot be filled in parallel because an angle is formed between the individual receiving chambers and the orientation of the groups of bags contained therein is thus different. A discharge into packaging containers supplied in parallel by a conveying means underneath the transportation means is thus not possible or can only be implemented under high constructional efforts.

Advantageously, with the present invention, two partial fillings are provided each packaging container and two opposite straight discharge sections are each provided with at least two discharge stations, the respectively first partial fillings being discharged to the packaging containers in the one discharge section and the respectively second partial fillings into the other discharge section. With the help of a transportation means both partial fillings for one packaging container are thus discharged from only one transportation means.

According to a simple development, in the discharge section which in the motional direction of the transportation means follows the supply section, the bags which are received in the second receiving chambers are discharged from said second chamber into a packaging container and the bags which are contained in the respectively other containers are discharged in the opposite discharge section into another packaging container which is then conveyed by means of the conveying means to the first discharge section.

In an advantageous development, the receiving chambers can receive a plurality of bags in one row and have a width which is smaller than the maximum lateral extension of a bag and larger than the minimum lateral extension of said bag. As a rule, sheet bags have an approximately rhomboid standing surface. In receiving chambers configured in this manner, such bags are oriented in inclined fashion, thereby reducing the space required by them.

In a simple development, the groups of bags that are received in one receiving chamber can be reduced by star-shaped wheels in the exterior area of the transportation means to a desired packing dimension. Such star-shaped wheels are simple mechanical and reliable constructional elements. The star-shaped wheels can be provided in straight sections of the transportation means or in the sections that are not straight.

Furthermore, it is of advantage when the discharge stations comprise ejection mechanisms with the aid of which the bags of a partial filling can each be ejected into packaging containers positioned thereunder, and when chutes are provided below the discharge stations of the transportation means, the chutes being designed such that the bags of one partial filling are discharged in a correct position into the packaging containers positioned thereunder. An ejection of the bags by the transportation means into packaging containers positioned thereunder constitutes a simple possibility of transfer. The chutes guarantee that the bags come to rest in a correct position.

Advantageously, the discharge operation for the bags is supported by ejection devices which eject the bags from the receiving chambers into the packaging containers positioned thereunder.

The transportation means may be designed as an endless conveyor in the manner of a link conveyor, the individual links carrying the receiving chambers. On the other hand, according to an advantageous development, a rail is provided that is engaged by holding means for the receiving chambers, with the holding means running in the rail. The holding means may be operative at various points of the receiving chambers, but advantageously on the back side of each receiving chamber. This ensures that the individual receiving chambers are spaced apart in the area of the sections that are not straight and do not present obstacles to one another.

BRIEF DESCRIPTION OF THE DRAWINGS

A preferred embodiment of the packing apparatus of the invention will now be described with reference to the attached figures, in which.

DETAILED DESCRIPTION OF THE PREFERRED EMBODIMENT

Described is a packing apparatus of the invention and a method of the invention used for beverage filled sheet bags.

The sheet bags in question consist, for example, of laminated aluminum foils. Two of such foils are welded together at the sides. At the bottom, a foldable standing base is inserted, so that the sheet bags become larger in downward direction when being filled.

Figure 1:
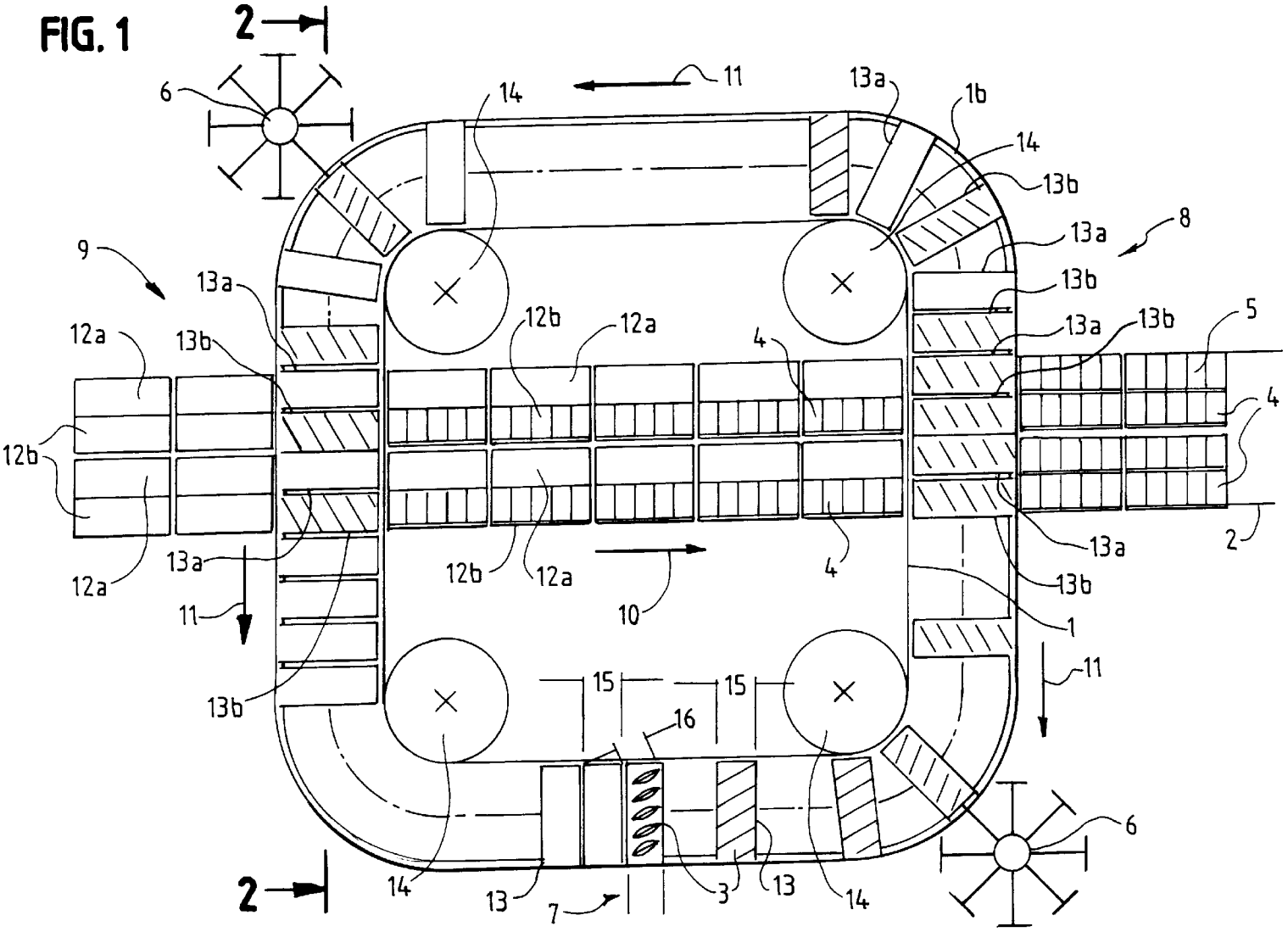
FIG. 1 is a schematic top view on a packing apparatus of the invention.

In the top view of FIG. 1, reference numeral 1 designates the transportation means including the receiving chambers 13. In the illustrated embodiment, the receiving chambers 13 are open in the direction of the outer periphery of the transportation means 1. Their width 15 is smaller than the width 16 of the sheet bags. The transportation means runs around deflection rollers 14 in the direction of arrow 11. Positioned below the transportation means 1 is a conveying means 2 which moves in linear fashion in the direction of arrow 10. Reference numeral 7 designates a supply station for supplying the sheet bags 4 into the receiving chambers 13. Reference numerals 4 and 5, respectively, designate sheet bags which have already come to rest in areas 12*b* and 12*a*, respectively, of the packaging containers 12. Reference numerals 8 and 9 designate the first discharge section and the second discharge section, respectively. Reference numerals 13*a* and 13*b* designate the second, fourth, sixth, . . . receiving chambers and the first, third, fifth, . . . receiving chambers, respectively, in the direction of movement of the transportation means 1. Reference numeral 6 designates star-shaped wheels which can engage into the open sides of the receiving chambers 13.

With the exception of the sheet bags which at the supply station 7 have been fed into the corresponding receiving chambers 13, the sheet bags in FIG. 1 are just represented by oblique strokes which are to symbolize the respective upper edges of the sheet bags.

In the illustrated embodiment, the transportation means 1 is connected to the receiving chambers 13 at the back side of said chambers. At their open side, the receiving chambers are supported by a support 1*b*. However, other configurations of the transportation means 1 are also possible.

Figure 2:
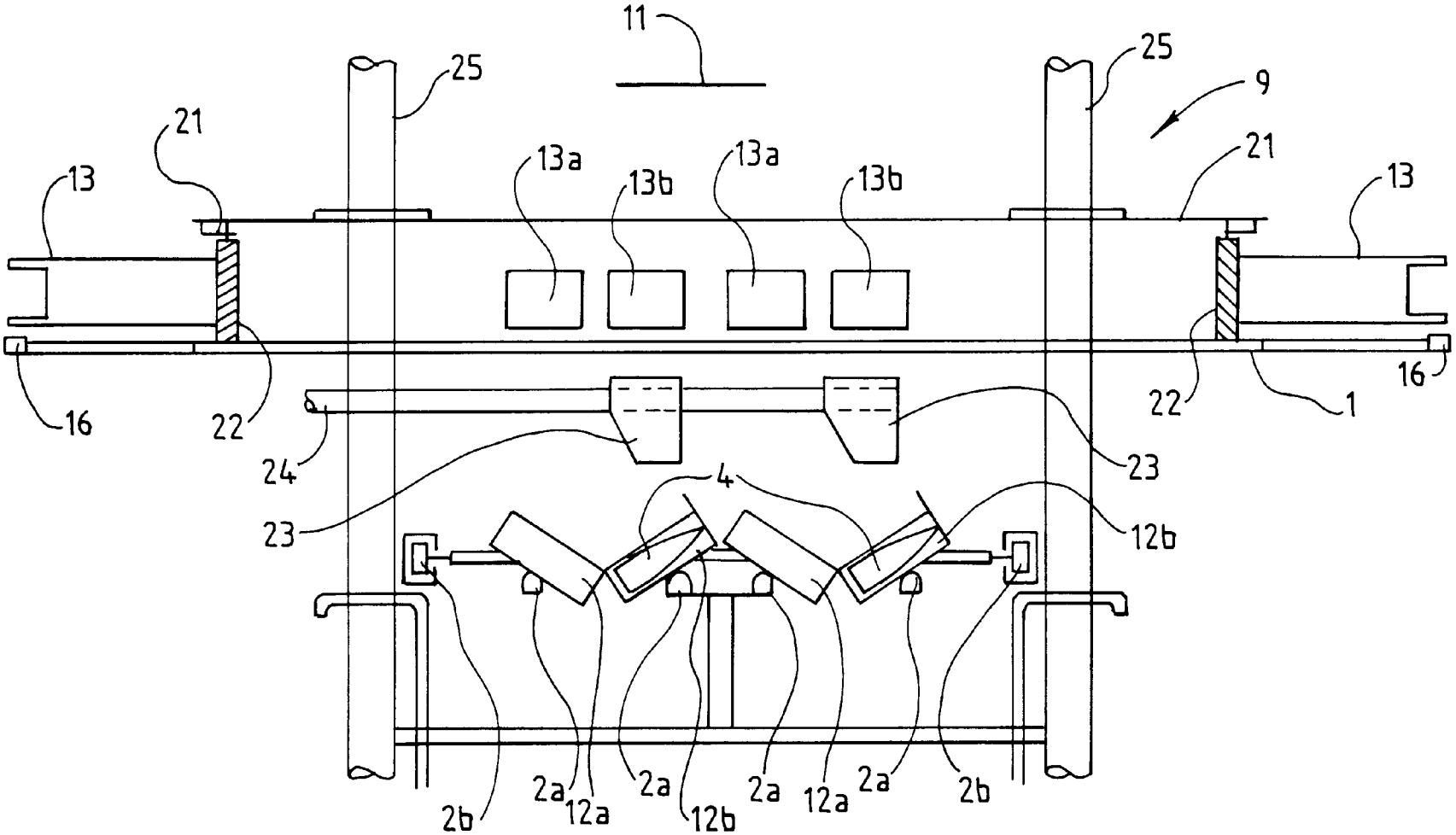
FIG. 2 is a section approximately taken along line I—I in FIG. 1.

FIG. 2 shows a section taken approximately along line I—I in FIG. 1. Identical elements are designated by identical reference numerals. Holding means 22 are shown that engage into rails 21 to enable the receiving chambers 13 to run along with the transportation means 1. In the illustrated embodiment, the conveying means 2 consists of running rails 2*a* and drive elements 2*b*. Reference numeral 23 designates chutes which are possibly activated in synchronism with the conveying means with the aid of a mechanism. The whole apparatus is supported by a support frame 25.

The apparatus operates as follows:

In the supply station 7 the sheet bags 3 are fed into the receiving chambers 13. To this end, they are transported into the receiving chambers 13 in a manner which is known per se, for instance with the help of a conveyor belt. The bags 3 may e.g. be sheet bags for beverages which have been filled in a preceding station and closed by sealing the upper edge. The receiving chambers 13 have a width which enables the sheet bags to be oriented in an inclined direction, as is shown in FIG. 1. In the illustrated example, five sheet bags are positioned in each of the receiving chambers. The transportation means 1 is operated intermittently. In the receiving chambers the bags are compressed by the star-shaped wheels 6 to their packing dimension. In the first discharge section 8, the second, fourth, sixth, . . . receiving chambers 13*a* are emptied. To this end, the bottom surfaces of the receiving chambers 13*a* which are just positioned in the discharge section 8 are opened. Two receiving chambers are emptied per working interval. The conveying means 2 moves in linear direction 10 underneath the transportation means. At the same rate as the transportation means, 1, the conveying means 2 transports two packaging containers 12, each in parallel with one another, underneath the first discharge section. The two discharge stations of the first discharge section 8 are here aligned relative to the packaging container 12 moved thereunder, in such a manner that in the first discharge section 8 the respectively second partial filling 5 is discharged into the corresponding portion 12*a* of the packaging container 12. FIG. 1 shows the discharge section 8 in a state shortly before the sheet bags are discharged from the receiving chambers 13*a*.

The receiving chambers 13, of which following the first discharge section 8 the first, third, fifth, . . . 13*b* are still filled, are moved further by the transportation means 1 to the second discharge section 9. The conveying means 2 moves empty packaging containers below the second discharge section 9. The receiving chambers 13 which have not been emptied yet are there discharged into the portion 12*b* of the packaging containers 12, corresponding to the first partial filling. To this end, those bottom portions of the receiving chambers 13*b* are opened that are just positioned in the second discharge section 9. FIG. 1 shows a state of the discharge section 9 shortly before the sheet bags are discharged from the receiving chambers 13*b*. The conveying means 2 then conveys the packaging containers 12, which are thereby filled up to half of their volume, to the first discharge section 8 in which the second partial filling 5 is introduced, as has been explained above.

FIG. 2 shows the second discharge section 9. In the second discharge section 9 as shown, the receiving chambers 13*b* are emptied. Chutes 23 which ensure that the bags 3 fall down in a correct position are respectively operated by a mechanism 24 in synchronism with the conveying means 2 and the transportation means 1, respectively. At the same time, the bottom portions of the receiving chambers 13*b* that are positioned in the discharge section 9 are opened by a mechanism (which is of no further interest). Such a mechanism can e.g. be obtained with the aid of a guide linkage for the bottom portions of the receiving chambers or by an electromagnetic closure. In the illustrated example, slides are provided as chutes that deposit the bags into corresponding portions 12*b* for the first partial filling 4 of the packaging containers 12. FIG. 2 shows the discharge section 9 shortly before the sheet bags are discharged into the portions 12*b* of the packaging containers. The discharging action can e.g. be supported by an ejection mechanism (not shown) which in the discharge stations engages into the receiving chambers from above and ejects the sheet bags 5 downwards.

The second partial area 12*a* of each packaging container 12 is filled in the first ejection section 8. In the illustrated embodiment, subsequent to the packing apparatus shown, the individual packaging containers 12 are folded together, so that a packaging container 12 contains two rows of five sheet bags each that are arranged side by side. When the two lateral surfaces of the sheet bags 3 differ from one another, e.g. due to a different imprint, the opposite arrangement of the discharge sections 8 and 9 ensures that the same lateral surface of the respective sheet bag 3 is oriented to the outside in the two portions 12*a* and 12*b* of the packaging containers 12.

To compress the individual bags 3 in the respective receiving chambers 13 to the desired packing dimension, star-shaped wheels 6 are provided in the exterior portion of the transportation means 1 for engaging into the individual receiving chambers 12 and for compressing the bags in said chambers in a desired manner. In the illustrated embodiment, the star-shaped wheels are located in the deflection areas in front of the respective discharge sections 8, 9. Depending on the respective requirements, however, any desired number of star-shaped wheels can be provided at different locations in the exterior portion of the transportation means 1.

Thanks to the straight sections of the transportation means 1, two rows of sheet bags can be discharged in parallel into two packaging containers moved thereunder in parallel. Since the discharge sections 8, 9 are arranged on the straight portions of the transportation means 1, no angle is created between the receiving chambers which are respectively ejected in the ejection sections 8, whereby a parallel discharge of two partial groups of sheet bags would be made impossible in two packaging containers that are transported side by side. Hence, throughput and efficiency of a packing apparatus of the inventive type are increased considerably.

We claim:

1. A packing apparatus for bags in packaging containers, comprising in combination:

an endless transportation means including a plurality of receiving chambers in each of which a group of bags respectively transported that is to form a partial filling of one of at least two packaging containers, the bags of one partial filling having the same orientation with respect to one another;

a supply station in which the bags are supplied to said receiving chambers;

a conveying means for supplying and discharging at least two packaging containers to at least two discharge stations, wherein at each of said discharge stations, the bags corresponding to a partial filling are respectively discharged from said transportation means to a respective packaging container;

said endless transportation means being arranged above and across said conveying means;

said conveying means being configured to transport said at least two packaging containers (12) together in parallel and side by side; and that said endless transportation means (1) comprises a first and a second straight discharge section (8, 9) located directly above the conveying means, wherein said at least two discharge stations are respectively arranged in parallel to each other in each of said discharge sections for simultaneously respectively discharging at least two partial fillings into said at least two packaging containers.

2. The packing apparatus according to claim 1, wherein a first partial filling (4) and a second partial filling (5) are provided per packaging container (12), and there are provided said first and second straight discharge sections of said transportation means (1), the first partial fillings (4) being discharged to the packaging containers (12) in said first discharge section (9), and the second partial fillings being discharged into said packaging container in said second discharge section (8).

3. The packing apparatus according to claim 2, wherein said second discharge section (8) located in the upstream of the motional direction (11) of said conveying means (2) and said first discharge section (9) located in the downstream of the motional direction of said conveying means (2) means (1) follows said supply, each receiving chamber of a first group of said plurality of receiving chambers (13*a*) discharges the bags received in said chambers into a packaging container, and the bags contained in said second discharge section in each of said receiving chambers in a second group of said plurality of receiving chambers (13*b*) are discharged in said first discharge section (9) into another packaging container which is then conveyed by means of said conveying means (2) to said second discharge section (8).

4. The packing apparatus according to claim 1, 2, or 3, wherein each of said receiving chambers (13) can receive a plurality of bags (3) in one row and has a width (15) which is smaller than the maximum lateral extension of a bag (3) and greater than the minimum lateral extension of a bag.

5. The packing apparatus according to claim 1, and wherein a first and a second star-shaped wheel (6) are provided in the exterior portion of said transportation means (1) and are respectively located before said first and second straight discharge section with respect to the motional direction of said transportation means, said star-shaped wheels engage into a plurality of receiving openings of said receiving chambers (13) to compress the bags (3) received therein to a desired packing dimension.

6. The packing apparatus according to claim 5, wherein said star-shaped wheels (6) are provided in the sections of said transportation means (1) that are not straight.

7. The packing apparatus according to claim 5 or 6, wherein said star-shaped wheels are provided in straight sections of said transportation means (1).

8. The packing apparatus according to claim 1, 3 or 5, wherein said transportation means (1) comprises a rail (21) which is engaged by holding means (22) for said receiving chambers (13), said holding means (22) running in said rail (21).

9. The packing apparatus according to claim 1, wherein ejection mechanisms (24) provided in the area of said discharge stations, with the aid of which each of the bags (3) of a partial filling can be ejected into packaging containers (12) positioned thereunder.

10. The packing apparatus according to claim 9, wherein chutes (23) are provided below said discharge stations of said transportation means (1) and designed such that the bags (3) of a partial filling fall into the packaging containers (12) in a correct position.

11. The packing apparatus according to claim 9, wherein ejection devices which in the area of said discharge stations eject the bags from said receiving chambers into the packaging containers (12).

12. A method for packaging bags in packaging containers, comprising the steps of filling a plurality of pairs of packaging containers, the packaging containers of each of said pair being in parallel, transporting said packaging containers in parallel by a conveying means, discharging into a first of said plurality of pairs of packaging containers in a first discharge section the bags respectively corresponding to first partial fillings, discharging into a second of said plurality of pairs of packaging containers in a second discharge section the bags corresponding to second partial fillings, providing the same orientation to the bags of a partial filling with respect to one another, positioning said discharge sections on two opposite straight sections of an endless transportation means which transports the bags to said discharge sections in groups each corresponding to one partial filling.

* * * * *

UNITED STATES PATENT AND TRADEMARK OFFICE

CERTIFICATE OF CORRECTION

PATENT NO. : 6,067,772
DATED : May 30, 2000
INVENTOR(S) : Eberhard Kraft, Hans-Peter Wild It is certified that error appears in the above-identified patent and that said Letters Patent is hereby corrected as shown below:

Column 5,
Line 62, delete "means (1) follows said supply".

Column 6,
Lines 3-4, after "container" insert -- in said second discharge station--, and after "contained", delete "said second discharge section in";
Line 8, after "(8)" insert -- to receive the bags received in the receiving chambers of the first group of said plurality of receiving chambers.--

Signed and Sealed this

Thirty-first Day of July, 2001

*Attest:*

Nicholas P. Godici

*Attesting Officer*

NICHOLAS P. GODICI
*Acting Director of the United States Patent and Trademark Office*